US006648242B2

(12) United States Patent
Rogers et al.

(10) Patent No.: US 6,648,242 B2
(45) Date of Patent: Nov. 18, 2003

(54) OSCILLATING HIGH ENERGY DENSITY OUTPUT MECHANISM

(75) Inventors: Thomas W. Rogers, Union Grove, AL (US); Clifford V. Mitchell, Cullman, AL (US); Garry W. Weatherly, Madison, AL (US)

(73) Assignee: Advanced Systems Technologies, Huntsville, AL (US)

( * ) Notice: Subject to any disclaimer, the term of this patent is extended or adjusted under 35 U.S.C. 154(b) by 108 days.

(21) Appl. No.: 09/783,473

(22) Filed: Feb. 14, 2001

(65) Prior Publication Data

US 2002/0109017 A1 Aug. 15, 2002

(51) Int. Cl.[7] ..... B05B 3/00

(52) U.S. Cl. ..... 239/227; 239/244; 239/255; 239/261; 239/263.3; 239/264; 239/380

(58) Field of Search ..... 239/223, 225.1, 239/231, 237, 240, 244, 245, 255, 260, 261, 263.3, 264, 380

(56) References Cited

U.S. PATENT DOCUMENTS 3,460,988 A * 8/1969 Kenedy, Jr. et al.
3,619,311 A * 11/1971 Rose ..... 118/305
4,659,018 A * 4/1987 Shulman ..... 239/225.1
4,662,565 A * 5/1987 Waldrum ..... 239/236
5,163,615 A * 11/1992 Bauer ..... 239/237
5,228,623 A * 7/1993 Raghavan et al. ..... 239/227
5,236,504 A * 8/1993 Frikker ..... 118/323
5,849,099 A * 12/1998 McGuire ..... 134/10

* cited by examiner

*Primary Examiner*—Dinh Q. Nguyen
(74) *Attorney, Agent, or Firm*—Norman Friedland

(57) ABSTRACT

A mechanism that steers a high energy density output(s) in a shaking motion other than a rotating motion that when translated across a surface evenly affects the surface. One application can be used as an end effector. A pivot on the mechanism induces an angular motion that eliminates the tops and bottoms of the pattern produced by the shaking motion. As a waterjet stripping mechanism which may be an end effector, a nozzle or output manifold with one or more orifices or outputs is attached to a non-rotating tube eccentrically mounted within a rotating tube that shakes the nozzle or output manifold so as to direct the stream of water to the target in a skewed circular pattern.

34 Claims, 3 Drawing Sheets

LINEARLY TRANSLATED PATH OF A SINGLE ORIFICE NOZZLE

OSCILLATING HIGH ENERGY DENSITY OUTPUT MECHANISM

TECHNICAL FIELD

This invention relates to mechanism that is designed to steer or maneuver one or more small high energy density outputs across a surface to evenly affect the surface.

BACKGROUND OF THE INVENTION

As one skilled in this art will appreciate there are sundry mechanisms that are commercially available that are intended to "work" the surface of a substrate, such as to remove paint, coatings, and oxides, or to affect the material or change its mechanical characteristics such as peening, heating, annealing, tempering or hard surfacing and the like. These mechanisms typically utilize mediums for these purposes such as waterjets (with or without abrasives or additives), fluid jets (with or without abrasives or additives), lasers, white light, or other mediums. This invention contemplates mechanism for providing an oscillating pattern of the medium being utilized that is applied to the surface of the item intended to be targeted.

High energy density output mechanisms of the waterjet nozzle types that are utilized for removing coatings, paints and the like from substrates, for example, which are currently in practice are exemplified by the following patents:

U.S. Pat. No. 5,421,517 granted to Knudson et al on Jun. 6, 1995 entitled "High Pressure Waterjet Nozzle" describes a prior art waterjet system that is typically employed to remove for example the coatings applied to aircraft components, space vehicles used in outer space missions and the like. The high power waterjet nozzle of the type depicted in this patent includes mechanism for rotating a nozzle and when translated across a surface creates an array of jet streams discharging from orifices in a nozzle that defines a swath that is intended to uniformly strip the coating from the substrate. In particular an array of radially extended orifices located in the nozzle are dimensioned and located to define the amount of energy of the jet that provides the uniform stripping without incurring damage to the substrate.

U.S. Pat. No. 5,577,293 granted to Meredith et al on Nov. 26, 1996 entitled "Full Recovery Stripping System" discloses another high pressure waterjet nozzle capable of use for stripping coatings, paint and the like from substrates or components. The nozzle in the structure depicted in this patent includes radially spaced orifices that communicate with a source of high pressure water and the end effector supporting the nozzle is gimbal mounted to provide the desired motion of the nozzle and hence, the swath of highly energized jet stream developed by the nozzle.

High energy density output mechanism for "working" the surface of a substrate by peening is disclosed in the following patent.

U.S. Pat. No. 5,778,713 granted to Butler et al on Jul. 14, 1998 entitled "Method And Apparatus For Ultra High Pressure Water Jet Peening" discloses a nozzle with a single orifice that serves to discharge ultrahigh velocity waterjet that is utilized for peening the outer surface of an object so as to alter the properties of the material by localized compression and altering the crystal structure.

The first two identified patents in the immediate above paragraphs are owned by United Technologies Corporation by virtue of a direct assignment thereto or by ownership of the subsidiary noted directly in the patent. The latter patent is assigned to Waterjet Technology, Inc. which has no affiliation with the assignee of the present patent application. All of these patents are incorporated herein by reference and details to waterjet technology may be referred to these documents for additional information.

While this invention can be utilized in any of the applications described in the above paragraphs, the preferred embodiment of this invention relates to the technology that deals with high pressure and high velocity fluid flow that is utilized to remove paint or coatings from the substrate and is directly concerned with the pattern of the jetstream directed to the target. As one skilled in the art will appreciate, the heretofore waterjet nozzles are either fixed or movable in a rotational direction. The problem with these types of nozzles is that they have the propensity of cutting into or scaring the substrate unevenly and/or are less efficient than the invention to be described hereinbelow.

Rather than rotating the nozzle, this invention provides a shaking motion to the nozzle that could be linear in one or more directions, thus, allowing any combination of two dimensional motions from straight lines to circles to any Lissajous figure pattern. In accordance with this invention, the shake motion can be angular in one or more directions to achieve the same motion on the work surface or a combination of linear and angular motions.

The motion provided by the structure of this invention allows a much larger angular deviation from the normal to the surface than a rotating waterjet. The shaking motion eliminates the high pressure water swivel which is a relatively complicated structure requiring higher cost and requires higher maintenance. While the working pattern of rotated nozzles are always round, the pattern of the present invention could be square which simplifies the cleanup problem and reduces the over lap at the end of the process positions. The working head of the present invention lends itself to be smaller than the heretofore known rotating heads which is abundantly important in installations that utilize a vacuum recovery system of the type described in the U.S. Pat. No. 5,577,293, supra.

SUMMARY OF THE INVENTION

An object of this invention is to provide improved mechanism which steers or maneuvers one or more high energy density outputs as they are translated across a surface.

A still further object of this invention is to provide a waterjet system that provides a shaking motion to the nozzle rather than a rotational motion.

A feature of this invention is to mount the nozzle to the end of the non-rotating water transfer tube which is mounted in a housing that is pulley connected to a drive motor for rotating a cylindrical mass (rotating tube) which is offset from the centerline non-rotating eccentric tube. A pivot supports the housing at a judicious location and affects the motion of the non-rotating nozzle which in the present configuration moves in an oscillating fashion which is a circular motion. The assembly provides an angular motion limited by opposing bumpers to deform the circular motion of the nozzle.

A further feature of this invention is to provide structure which is characterized as easy to manufacture, assemble, operate and maintain, that is capable of being steered or maneuvered yet capable of utilizing several different mediums that guide small high energy density outputs in a pattern that when translated across a surface will evenly affect the surface.

The foregoing and other features of the present invention will become more apparent from the following description and accompanying drawings.

These figures merely serve to further clarify and illustrate the present invention and are not intended to limit the scope thereof.

DETAILED DESCRIPTION OF THE INVENTION

While this invention can be utilized for maneuvering or steering high energy density output(s) of different mediums the invention will describe in the preferred embodiment, mechanism with a non-rotating nozzle designed to have imparted thereto a small circular type oscillating motion (a very special case of linear, two dimensional motion) defining an arbitrary pattern with a pivot that allows small angular motion. The mechanism in this preferred embodiment is typically mounted on a robot and in industry this mechanism is often referred to as an "end effector". As one skilled in the art will appreciate, the position of the eccentric mounted pulley and rotating tube serves to change the pattern of the end effector and hence, nozzle or other output manifold. While the invention is particularly concerned with the removal of paint and/or coatings from the substrate, it will be appreciated that this invention can be employed to perform other functions, such as peening, surface hardening, to name but a few.

For the purpose of understanding the description of the invention the term small refers to the dimension of the swath of the output when the mechanism is in a stationary position when viewed relative to the total surface being worked. The term high energy density refers to the force or intensity of the medium wherein its interaction on the surface is such that if remained stationary at a given period of time the interaction would cut into the surface of the item being worked on or damage said surface.

Figure 1:
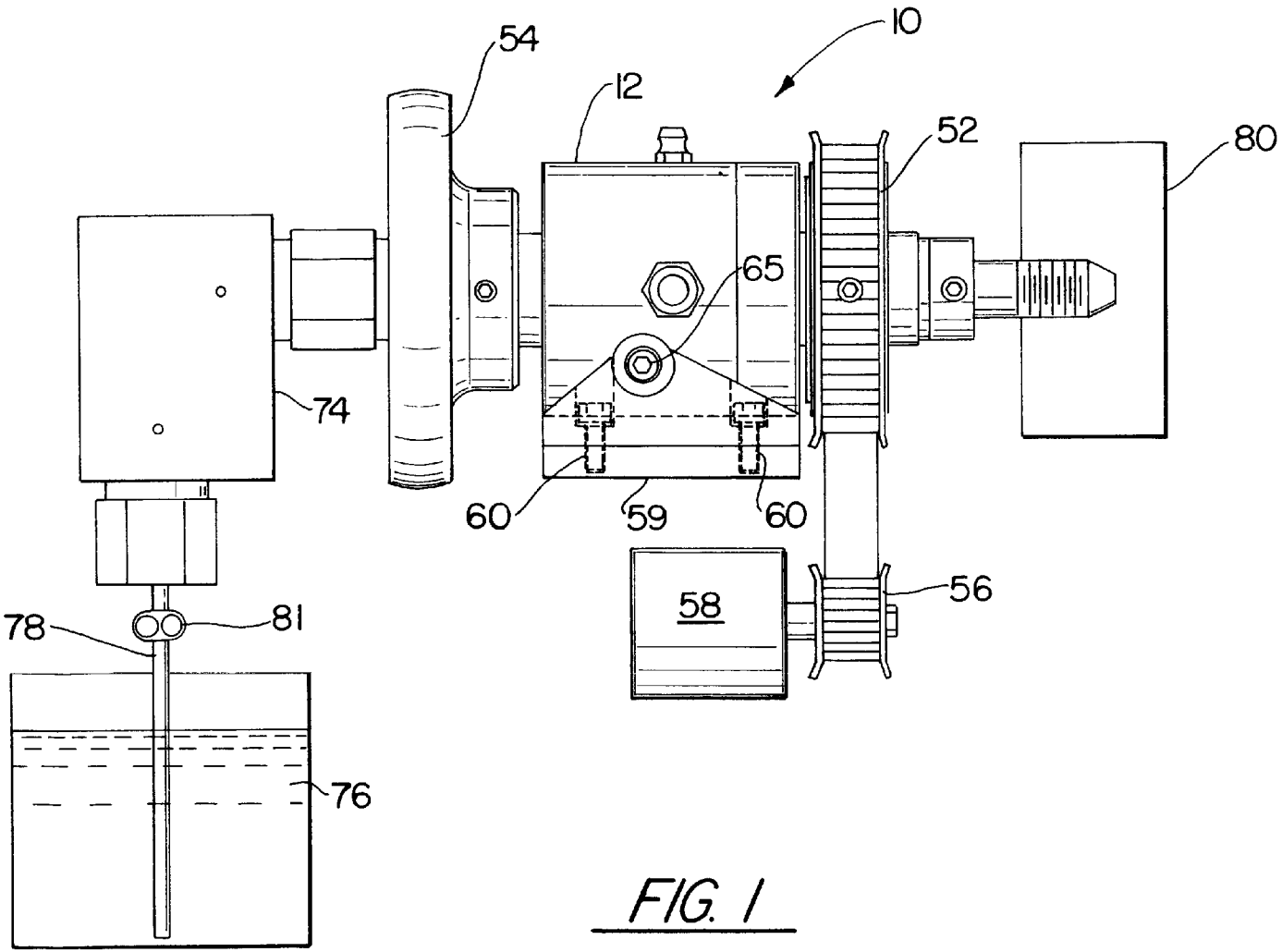
FIG. 1 is a view partly in schematic and partly in elevation illustrating the invention.
Figures 2, 3:
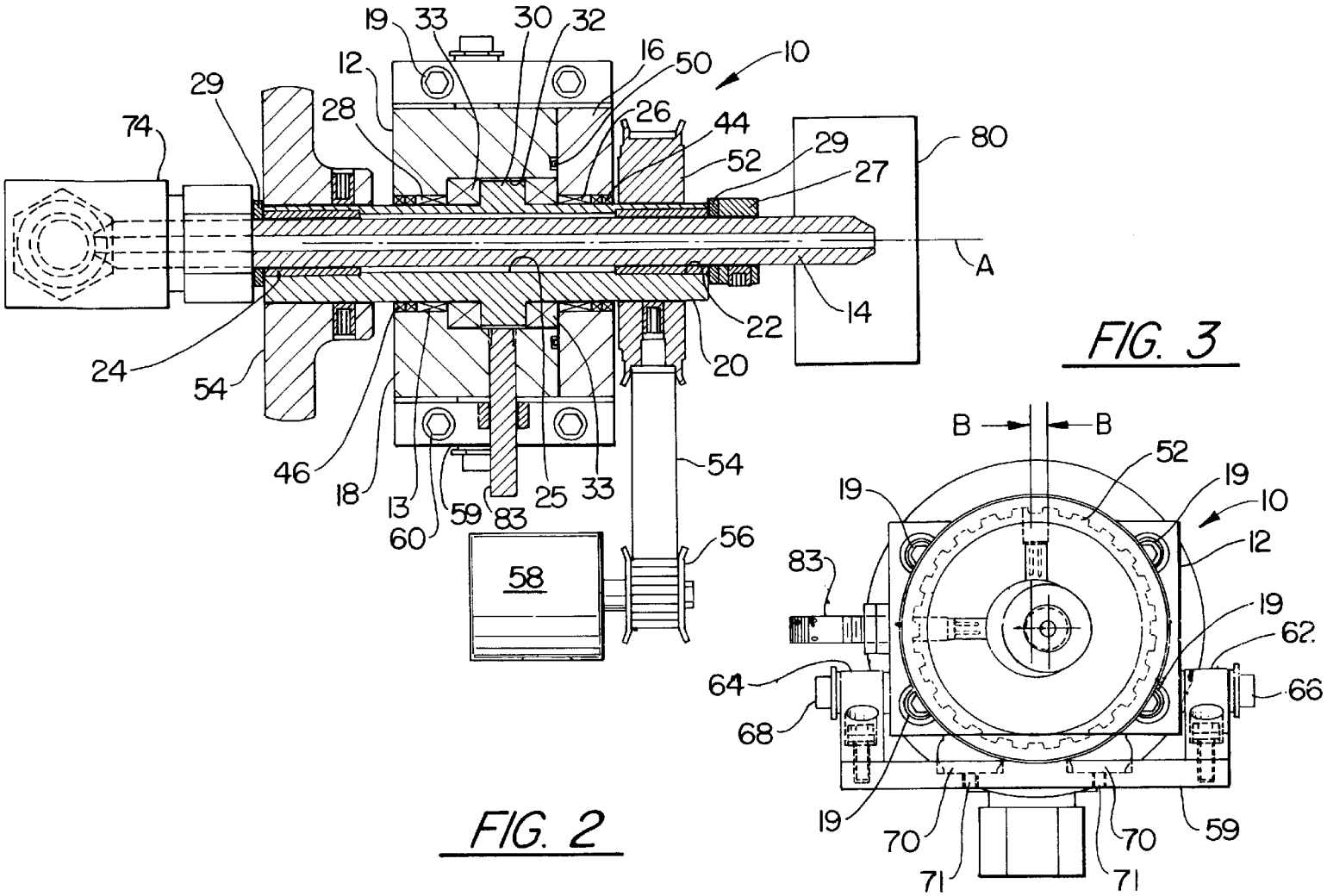
FIG. 2 is a view partly in section and partly in schematic of the embodiment depicted in FIG. 1.
FIG. 3 is a plan end view of the embodiment of FIG. 1.

As best shown in FIGS. 1–3, the invention comprises the end-effector generally illustrated by reference numeral 10 having a main generally rectangular shaped housing or block 12 having a central bore 13. Housing 12 may be formed from two parts, fore portion 16 and aft portion 18 that are affixed by suitable bolts 19 and together the housing 12 supports the rotating tube 20 mounted in the central bore 13. As noted, rotating tube 20 is rotatably supported by the commercially available needle bearings 26 and 28. A flange 30 formed intermediate the ends of rotating tube 20 extending radially in the enlarged diameter portion 32 of bore 13 serves to form opposing shoulders for thrust bearings 33. Obviously, the assembly is lubricated and suitable commercially available seals are suitably located to prevent lubricant leakage, which are the end seals 44 and 46 and O-ring 50. Mounted and affixed to the rotating tube 20 are the pulley 52 and the hand-wheel 54. The pulley serves to rotate the rotating tube 20 and is suitably attached to the drive wheel 56 of a suitable motor 58 shown in schematic and a suitable commercially available rubber or elastomeric belt 54 connected to the drive wheel 56 and pulley 52 which will be described in further detail hereinbelow. As one skilled in this art appreciates the pulley arrangement can be easily replaced by a gearing arrangement without departing from the scope of this invention. The commercially available motor 58 may be any of the well known types such as air or fluid driven or electric and serves to drive the rotating tube 20 at say, between 300 to 600 revolutions per minute (RPM) which speed is predicated on the particular task for the end effector.

The hand wheel 54 is also suitably affixed to the rotating tube 20 and rotates therewith and serves as a convenient way to set the end effector during set up at the initial start of the coating removal task.

In accordance with this invention a through hole 25 is bored into rotating tube 20, extends therethrough and is located off centerline A by an amount shown by letter B to define an eccentric as will be described hereinbelow. It is apparent from the foregoing that the centerline of non-rotating tube, 14 rotates in a circle of radius B about centerline A. The non-rotating tube 14 is supported by sleeve bearings 22 and 24 which are mounted at either end of the rotating tube 20 and disposed between outer diameter of the fixed high pressure tube 14 and inner diameter of the rotating tube 20. Shaft collar 27 and thrust washer 29 surrounding the fixed tube 14 and at each end of tube 20 and serves to secure the fixed tube 14 into place and hold the fixed tube 14 inside the rotating tube 20.

Also, in accordance with this invention and to achieve the angular deflection of the nozzle, the main housing 12 is pivotally affixed to the bottom plate 59 by suitable bolts 66 and 68 via the trunnion supports 62 and 64. Opposing cap screws are mounted in diametrically opposed bores formed in the trunnion supports 62 and 64 and form a pivot 65 for the main housing. As will be described in further detail hereinbelow the main housing by virtue of the relaxation and tension of the belt on pulley 52 as it drives the rotating tube 20 causes the housing to slightly pivot and bounce against the rubber or elastomeric members or bumpers 70. The assembly provides four rubber or elastomeric bumpers 70 which are toroidally shaped to accommodate a screw 71 through the center thereof to affix the bumpers 70 on opposite sides of the inner face of bottom plate 59 attached by screws 60. The housing engages the bumpers 70 in a timely fashion as will be described hereinbelow.

In operation, a suitable nozzle 80 depicted schematically and may be the the type described in U.S. Pat. No. 5,421,517, supra, or any other nozzle is attached to the end of the non-rotating tube 14 where the threads are formed and may include one or more outlets as is desired and is imparted the pattern dictated by the setting of the eccentric and pivot 65. In this preferred embodiment, high pressure water at a ultra high velocity is fed thereto from the reservoir 76 through the suitable well known pump 81, connecting line 78, fitting 74 through the non-rotating tube 14 and ultimately through the orifices in the nozzle 80. The motor is actuated and drives the drive pulley 56, which in turn drives belt 54 and in turn, rotates pulley 52. Because the fixed or non-rotating tube 14 and the rotating tube 20 are eccentric relative to each other as shown in FIG. 3 and the space depicted by the vertical lines B—B the nozzle will be imparted a shake pattern where the motion is in small circles.

As described above the end effector of this invention also provides an angular motion. This is provided by the pivot 65. The purpose of the angular motion is to eliminate the evenness of the tops and bottoms of the small circle or skew the small circles defined by the shake movement, so that the edges of the circle are smeared as the pattern is translated across the surface being treated. Without the pivot 65 we have found that the even edges of a perfectly circular pattern causes the stripped surface of the substrate to be overworked. In the preferred embodiment the driven pulley 52 has 48 teeth and the driving pulley 56 carries 19 teeth. The motor or driving pulley 56 is bored slightly center so that at each turn of the motor the toothed belt pulls the pivoted assembly into the front set of bumpers. As the driving pulley 52 moves away from the high spot the belt tension decreases and allows the bumpers 70 to move the pivoted housing 12 unforced in a nodding or rocking motion. Because of the differences in the number of teeth in the drive and driven pulleys there will be 48 such angular kicks in 19 rotations of the eccentric circular pattern before the pattern of angular kicks and eccentric positions repeats. This length makes the angular motion appear to be random.

The housing 12 is implemented with a commercially available proximity sensor 83 that extends radially into housing 12 and is spaced relative to the peripheral surface of the flange 32 and serves to measure the speed of the rotating shaft 20. This sensor is optional and does not constitute a part of this invention.

Figure 4:
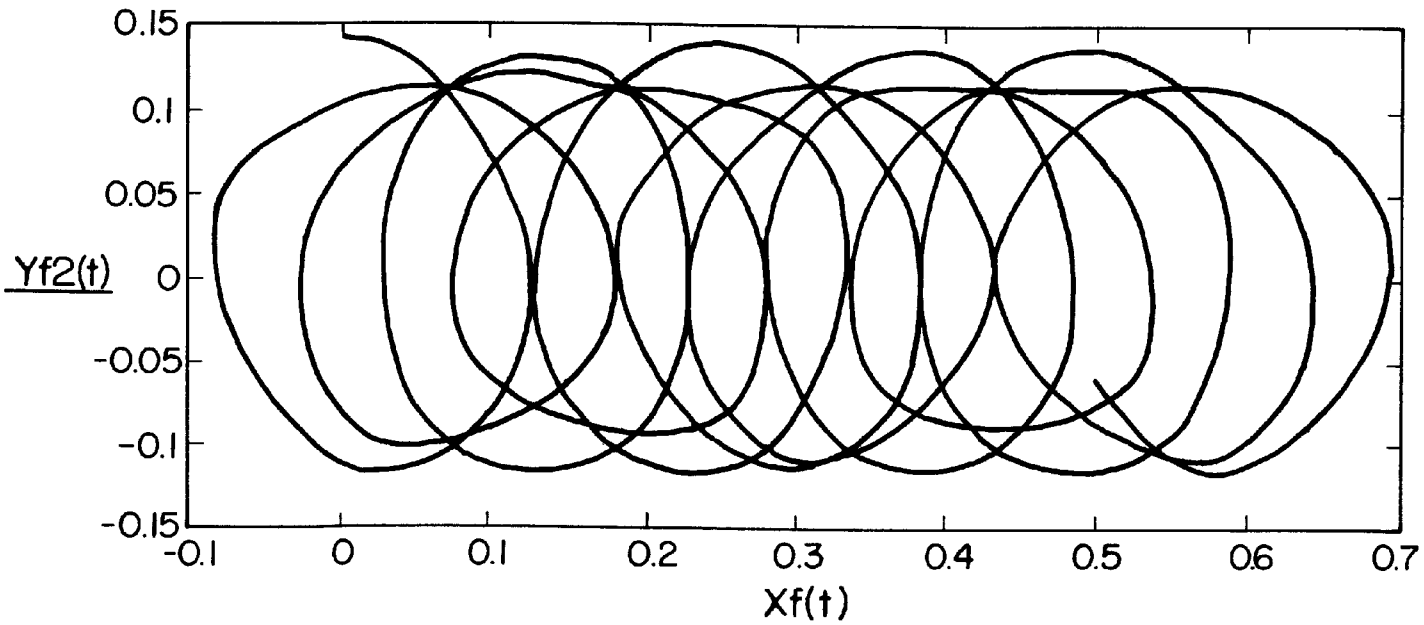
FIG. 4 is a graphical illustration of the motion across a surface produced from a simulation of a single orifice nozzle motion pattern with linear translation, and is illustrative of one of the many patterns that can be created by the present invention.

FIG. 4 is a plot of the simulation of the center of a one orifice nozzle linearly translated across a flat surface. The pattern developed by this invention are small circles but with edges that are skewed. The smearing of the edges of a mostly circular pattern prevents the edges from becoming overworked.

Obviously, this mechanism described in the above paragraphs can be simply modified to include additives or abrasives to the water or could substitute other fluid mediums. Moreover, it is contemplated by the scope of this invention that the mechanism can be employed for peening or surface hardening or other purposes and could use other mediums for "working" the surface, such as laser, white light and the like.

Although this invention has been shown and described with respect to detailed embodiments thereof, it will be appreciated and understood by those skilled in the art that various changes in form and detail thereof may be made without departing from the spirit and scope of the claimed invention.

It is claimed:

1. Mechanism that maneuvers one or more small high energy density outputs for working a surface of a substrate including a housing, said housing producing a shaking motion to said one or more small high energy density outputs so as to be linear in one or more directions to allow any combination of two dimensional motions of said one or more small high energy density outputs including straight lines, circles or any Lissajous figure pattern, at least one of said small high energy motions being circular and an actuator for moving said housing to create a skewed motion of the circle produced thereby and said housing being moved at a fixed rate, and said output is a waterjet.

2. Mechanism that maneuvers one or more high energy density outputs for working the surface of a substrate including a housing having a bore, a rotating tube mounted in said bore around a fixed axial axis, a fixed hollow tube mounted in said rotating tube about a different axial axis, drive mechanism to rotate the rotating tube at a given rotational speed so as to shake the fixed hollow tube at a given shake pattern, an energy receiving device having said one or more output devices mounted on said fixed hollow tube whereby said energy receiving device is imparted a shaking motion and said energy receiving device discharging the energy to a target for working the surface of the substrate.

3. Mechanism that maneuvers one or more high energy density outputs for working the surface of a substrate as claimed in claim 2 including a pivot, said mechanism mounted on said pivot so as to pivot the fixed hollow tube and the rotating tube in an oscillating movement at predetermined periods of time so as to impart an angular movement thereto so as skew the shake pattern.

4. Mechanism that maneuvers one or more high energy density outputs for working the surface of a substrate as claimed in claim 3 wherein said housing includes a fore end and an aft end, said rotating tube extending beyond said fore end, a pulley or gear mounted on said fore end and being affixed to said rotating tube, a driving mechanism including an interconnection for driving said driving mechanism and said rotating tube, and bearing in said bore supporting said rotating tube.

5. Mechanism that maneuvers one or more high energy density outputs for working the surface of a substrate as claimed in claim 4 wherein said rotating tube is subjected to thrust loads, said rotating tube having a fore end and an aft end, said rotating tube includes a flange portion carried at a location intermediate said fore end and said aft end and extending in an enlarged diameter of said bore, thrust bearings supporting said flange to absorb a thrust load imparted to said rotating tube.

6. Mechanism that maneuvers one or more high energy density outputs for working the surface of a substrate as claimed in claim 5 wherein said fixed tube extends beyond said rotating tube, a collar affixed to said fixed tube mounted adjacent to said rotating tube and a thrust washer surrounding said fixed tube and being mounted between said collar and said rotating tube for securing said rotating tube in a fixed axial position relative to said fixed tube.

7. Mechanism that maneuvers one or more high energy density outputs for working the surface of a substrate as claimed in claim 6 including a bottom plate, a trunnion support member sandwiching said housing and defining said pivot, said pivot connecting said housing to said bottom plate, opposing bumpers mounted on said bottom plate and located so that said housing abuts opposing bumpers as said housing oscillates about said pivot when said pulley or gear is being rotated.

8. Mechanism that maneuvers one or more high energy density outputs for working the surface of a substrate as claimed in claim 7 wherein said driving mechanism includes a second pulley or gear eccentrically mounted relative to said pulley and a belt made from a resilient material interconnecting said second pulley or gear and said pulley or gear to cause said housing to oscillate about said pivot.

9. Mechanism that maneuvers one or more high energy density outputs for working the surface of a substrate as claimed in claim 8 wherein said rotating tube extends beyond said aft portion of said housing, a hand wheel affixed to said rotating tube at the juncture where said rotating tube extends beyond said aft portion so as to manually rotate said rotating tube.

10. A waterjet oscillating mechanism for producing an ultra high energy stream of water aimed at a target intended to be treated comprising a housing, a fixed tube extending through a through bore in said housing and having one end connected to a source of an ultra high energy water and the opposite end communicating with an output and being disposed along a central axis, a rotating tube surrounding said fixed tube disposed in said bore and disposed along a different but parallel axis, bearings means for supporting said fixed tube inside said rotating tube and supporting said rotating tube in said bore and said rotating tube being rotatable relative to said housing and said fixed tube, and means for imparting rotary motion to said rotating tube and means for directing ultra high energy stream of water from said source, though said fixed tube, through said output in a predefined pattern to the target for stripping material from a substrate.

11. A waterjet oscillating mechanism for producing an ultra high energy stream of water aimed at a target intended to be treated as claimed in claim 10 including a bottom plate being attached to said housing by a pivot for pivotally supporting said housing, diametrically opposed bumpers mounted on said bottom plate, said housing being oscillated about said pivot to alternately bump up against said diametrically opposed bumpers to change the pattern of said ultra high energy stream of water.

12. A waterjet oscillating mechanism for producing an ultra high energy stream of water aimed at a target intended to be treated as claimed in claim 11 wherein said housing having a fore end and an aft end, said rotating tube extends beyond the fore end of said housing and said fixed tube extends beyond said rotating tube extending beyond said fore end, a collar affixed to said fixed tube for affixing said rotating tube in said bore of said housing.

13. A waterjet oscillating mechanism for producing an ultra high energy stream of water aimed at a target intended to be treated as claimed in claim 12 wherein said bearing means supporting said fixed tube inside said rotating tube is journal bearings and for supporting said rotating tube to be rotatable relative to said fixed tube and said housing is needle bearings.

14. A waterjet oscillating mechanism for producing an ultra high energy stream of water aimed at a target intended to be treated as claimed in claim 13 wherein said fixed tube and said hollow tube extend beyond the aft end of said housing, and a thrust washer disposed on said fixed tube adjacent to said aft end of said rotating tube for supporting said rotating tube.

15. A waterjet oscillating mechanism for producing an ultra high energy stream of water aimed at a target intended to be treated as claimed in claim 14 wherein said means for imparting rotary motion includes a drive pulley and a driven pulley, said driven pulley being affixed to said rotating tube and said drive pulley being driven by a motor and a drive belt interconnecting said drive pulley and said driven pulley.

16. A waterjet oscillating mechanism for producing an ultra high energy stream of water aimed at a target intended to be treated as claimed in claim 15 wherein said drive belt subjected to vary levels of force, said drive pulley being eccentrically mounted relative to said driven pulley to cause said drive belt to vary the level of force between said drive pulley and said driven pulley so as to cause said housing to oscillate about said pivot.

17. A waterjet oscillating mechanism for producing an ultra high energy stream of water aimed at a target intended to be treated as claimed in claim 16 including a hand wheel connected to said rotating tube at the aft end of said housing for rotating said tube when said motor is inoperative condition.

18. A waterjet oscillating mechanism for producing an ultra high energy stream of water aimed at a target intended to be treated as claimed in claim 17 wherein said rotating tube includes a flange extending in an increased diameter portion of said bore and thrust bearings adapted to absorb thrust loads mounted in said increased diameter to bear against said flange to absorb thrust loads imposed by the high energy stream of water.

19. A waterjet oscillating mechanism for producing an ultra high energy stream of water aimed at a target intended to be treated comprising a housing, a fixed tube extending through a through bore in said housing and having one end connected to a source of an ultra high energy water and the opposite end communicating with an output and being disposed along a central axis, a rotating tube surrounding said fixed tube disposed in said bore and disposed along a different but parallel axis, bearings for supporting said fixed tube inside said rotating tube and supporting said rotating tube in said bore and said rotating tube being rotatable relative to said housing and said fixed tube, and means for imparting rotary motion to said rotating tube and means for directing ultra high energy stream of water from said source, though said fixed tube, through said output in a predefined pattern to the target for stripping material from a substrate, a bottom plate being attached to said housing by a pivot for pivotally supporting said housing, diametrically opposed bumpers mounted on said bottom plate, said housing being oscillated about said pivot to alternately bump up against said diametrically opposed bumpers to change the pattern of said ultra high energy stream of water.

20. A waterjet oscillating mechanism for producing an ultra high energy stream of water aimed at a target intended to be treated as claimed in claim 19 wherein said housing includes a fore end and an aft end, said rotating tube extends beyond said fore end of said housing and said fixed tube extends beyond said rotating tube and said fore end, a collar affixed to said fixed tube for affixing said rotating tube in said bore of said housing.

21. A waterjet oscillating mechanism for producing an ultra high energy stream of water aimed at a target intended to be treated as claimed in claim 20 wherein said bearing means supporting said fixed tube inside said rotating tube is journal bearings and for supporting said rotating tube to be rotatable relative to said fixed tube and said housing is needle bearings.

22. A waterjet oscillating mechanism for producing an ultra high energy stream of water aimed at a target intended to be treated as claimed in claim 21 wherein said fixed tube and said hollow tube extend beyond said aft end of said housing, and thrust washer disposed on said fixed tube for supporting said rotating tube.

23. A waterjet oscillating mechanism for producing an ultra high energy stream of water aimed at a target intended to be treated as claimed in claim 22 wherein said means for imparting rotary motion includes a drive pulley and a driven pulley, said driven pulley being affixed to said rotating tube and said drive pulley being driven by a motor and a drive belt interconnecting said drive pulley and said driven pulley.

24. A waterjet oscillating mechanism for producing an ultra high energy stream of water aimed at a target intended to be treated as claimed in claim 23 wherein said drive belt is subjected to varying levels of force, said drive pulley being eccentrically mounted relative to said driven pulley to cause said drive belt to vary the level of force between said drive pulley and said driven pulley so as to cause said housing to oscillate about said pivot.

25. A waterjet oscillating mechanism for producing an ultra high energy stream of water aimed at a target intended to be treated as claimed in claim 24 including a hand wheel connected to said rotating tube at the aft end of said housing for rotating said tube when said motor is inoperative condition.

26. A waterjet oscillating mechanism for producing an ultra high energy stream of water aimed at a target intended to be treated as claimed in claim 25 wherein said rotating tube includes a flange extending in an increased diameter portion of said bore and thrust bearings adapted to absorb thrust loads mounted in said increased diameter to bear against said flange to absorb thrust loads imposed by the high energy stream of water.

27. An end effector including an output manifold having one or more outlets for impinging water on a surface intended to be treated at a predefined pattern, waterjet oscillating mechanism for producing an ultra high energy stream of water to flow through said one or more outlets aimed at a target intended to be treated comprising a housing, a fixed tube extending though a bore in said housing and having one end connected to a source of an ultra high energy water and the opposite end communicating with said output manifold and being disposed along a central axis, a rotating tube surrounding said fixed tube disposed in said bore and disposed along a different but parallel axis, bearing means for supporting said fixed tube inside said rotating tube and supporting said rotating tube in said bore and said rotating tube being rotatable relative to said housing and said fixed tube, and means for imparting rotary motion to said rotating tube and means for directing ultra high energy stream of water from said source, though said fixed tube, though said output manifold and though one or more outlets in a predefined pattern to the target for stripping material from a substrate, a bottom plate being attached to said housing by a pivot for pivotally supporting said housing, diametrically opposed bumpers mounted on said bottom plate, said housing being oscillated about said pivot to alternately bump up against said diametrically opposed bumpers to change the pattern of said ultra high energy stream of water discharging from said output manifold.

28. An end effector including a nozzle having one or more outputs a claimed in claim 27 wherein said housing includes a fore end and an aft end, said rotating tube e ends beyond the fore end of said housing and said fixed tube extends beyond said rotating tube where said rotating tube extends beyond said fore end, a collar affixed to said fixed tube for affixing said rotating tube in said bore of said housing.

29. An end effector including a nozzle having one or more outputs as claimed in claim 28 wherein said bearing means supporting said fixed tube inside said rotating tube is journal bearings and for supporting said rotating tube to be rotatable relative to said fixed tube and said housing is needle bearings.

30. An end effector including a nozzle having one or more outputs a claimed in claim 29 wherein said fixed tube and said hollow tube extend beyond the aft end of said housing, and thrust washer disposed on said fixed tube for supporting said rotating tube.

31. An end effector including a nozzle having one or more outputs as claimed in claim 30 wherein said means for imparting rotary motion includes a drive pulley and a driven pulley, said driven pulley being affixed to said rotating tube and said drive pulley being driven by a motor and a drive belt interconnecting said drive pulley and said driven pulley.

32. An end effector including a nozzle having one or more outputs a claimed in claim 31 wherein said drive belt being subjected to varying levels of force, said drive pulley being eccentrically mounted relative to said driven pulley to cause said drive belt to vary the level of force between said drive pulley and said driven pulley so as to cause said housing to oscillate about said pivot.

33. An end effector including a nozzle having one or more outputs as claimed in claim 32 including a hand wheel connected to said rotating tube at the aft end of said housing for rotating said tube when said motor is inoperative condition.

34. An end effector including a nozzle having one or more outputs as claimed in claim 32 wherein said rotating tube includes a flange extending in an increased diameter portion of said bore and thrust bearings mounted in said increased diameter to bear against said flange to absorb the thrust loads imposed by the high energy stream of water.

* * * * *